United States Patent [19]

Ostrom

[11] 4,203,340

[45] May 20, 1980

[54] ELECTRONIC MUSICAL INSTRUMENT

[75] Inventor: David E. Ostrom, Walnut Creek, Calif.

[73] Assignee: O/R Inc., Walnut Creek, Calif.

[21] Appl. No.: 6,726

[22] Filed: Jan. 26, 1979

[51] Int. Cl.[2] ..... G10H 1/02; G10H 5/00

[52] U.S. Cl. ..... 84/1.26; 84/DIG. 2; 84/DIG. 8; 84/DIG. 20

[58] Field of Search ..... 84/1.01, 1.13, 1.26, 84/DIG. 2, DIG. 8, DIG. 20

[56] References Cited

U.S. PATENT DOCUMENTS

| | | | |
|---|---|---|---|
| 3,733,955 | 5/1973 | Reinagel et al. | 84/1.01 |
| 3,786,166 | 1/1974 | Mieda | 84/1.01 |
| 3,828,108 | 8/1974 | Thompson | 84/1.01 |
| 3,918,342 | 11/1975 | Mieda | 84/1.01 |
| 3,948,137 | 4/1976 | Niinomi | 84/1.01 |
| 3,991,645 | 11/1976 | Luce et al. | 84/1.01 |
| 4,012,980 | 3/1977 | Suzuki | 84/1.01 |
| 4,016,792 | 4/1977 | Schrecongost | 84/1.01 |
| 4,041,826 | 8/1977 | Oya | 84/1.01 |
| 4,043,242 | 8/1977 | Cavicchio | 84/1.01 X |
| 4,098,162 | 7/1978 | Okamoto et al. | 84/1.01 |

OTHER PUBLICATIONS

Manual of Linear Integrated Circuits, Sol. D. Prensky, Reston, 1974, pp. 31–41.

The Electronic Musical Instrument Manual, Alan Douglas, TAB Books, 6th Edition, 1976, pp. 20–27, 152 & 153.

The Way Things Work, vol. II, Simon and Schuster, 1971, pp. 454–467.

Buchbaum's Complete Handbook of Practical Electronic Reference Data, Prentice Hall, 6th Edition, 1976, pp. 67–69, 218–221 & 316–319.

Handbook of Physics and Chemistry, 42nd Edition, 1961, pp. 2502–2503.

Manual for Integrated Circuit Users, John D. Lenk, Reston, 1973.

*Primary Examiner*—S. J. Witkowski

*Attorney, Agent, or Firm*—Limbach, Limbach & Sutton

[57] ABSTRACT

An electronic musical instrument includes a tone signal generator whose operation is controlled by active electronic signal processing. The instrument includes both tone effect control means to provide an alternating current control signal to the tone signal generator and manually operable tone frequency control means having selectively variable resistance and selectively variable capacitance characteristics, with one of these characteristics being variable among logarithmically spaced increments and the other characteristic being variable among linearly spaced increments.

6 Claims, 2 Drawing Figures

ELECTRONIC MUSICAL INSTRUMENT

BACKGROUND OF THE INVENTION

Various types of electronic musical instruments have been available for many years. Perhaps the best known type of electronic instrument is the electronic organ in which a set of tone generators produces electrical oscillation and those oscillations are then passed through filters to filter out the undesired tonal aspects and then to an amplifier which amplifies the tone and provides it to a loudspeaker. The tone generator conventionally is a feedback oscillator connected to a frequency divider, or, alternatively, vibrating metal reeds for generating the tone. The filters are applied to the signal received from the generators to filter out undesired overtones and pass through only the portions of the generated signal which resemble the sound being desired.

Another structure similar to an electronic organ but capable of far more complex tonal output is that commonly referred to as the Moog synthesizer, which similarly functions by applying filters to the output of a signal generator to filter out unwanted components. In both of these types of prior art instruments it has been necessary to provide at least twelve oscillators for the top octave of musical notes to be produced. The lower octaves are then obtained from these oscillators by circuits which divide the frequency to obtain the other, lower octaves. The necessity for this plurality of oscillators or signal generators has meant that there has been substantial complexity and attendant expense in these prior art devices. It has also been found inefficient to obtain a tone corresponding to a predetermined waveform by producing a signal having a substantially more complex waveform and then utilizing filtering to remove the undesired components.

SUMMARY OF THE INVENTION

In view of the complexities and disadvantages of the prior art electronic musical instruments, it is an object of the present invention to provide a comparatively simple and inexpensive instrument capable of producing musical tones.

It is a further object of this invention to provide such an instrument in which the tones are controlled by active signal processing instead of passive filtering. More particularly, it is an object of this invention to provide such an apparatus in which the tone effect is obtained by providing control signals to the tone generator.

To achieve these and other objects which will become apparent from the detailed description below, an electronic instrument for producing musical tones is disclosed which includes selectively controllable tone effect control means, manually operable tone frequency control means and tone signal generating means operatively connected to both the tone effect control means and the tone frequency control means. The tone effect control means is selectively controllable to provide an alterating current output signal having selectably differing waveform characteristics and selectively varying rise and decay times and selectively varying amplitude and frequency. The tone frequency control means has both a selectively variable electrical resistance characteristic and a selectively variable capacitance characteristic, with one of these characteristics being variable among logarithmically spaced increments and the other characteristic being variable among linearly spaced increments. The tone signal generating means thus generates an output tone signal having a frequency proportional to both the selected resistance and selected capacitance of the tone frequency control and having a waveform corresponding at least partially to the tone effect control signal.

BRIEF DESCRIPTION OF THE DRAWINGS

A preferred embodiment of the musical instrument of this invention will be described in detail below, in which.

DESCRIPTION OF THE PREFERRED EMBODIMENT

Figure 1:
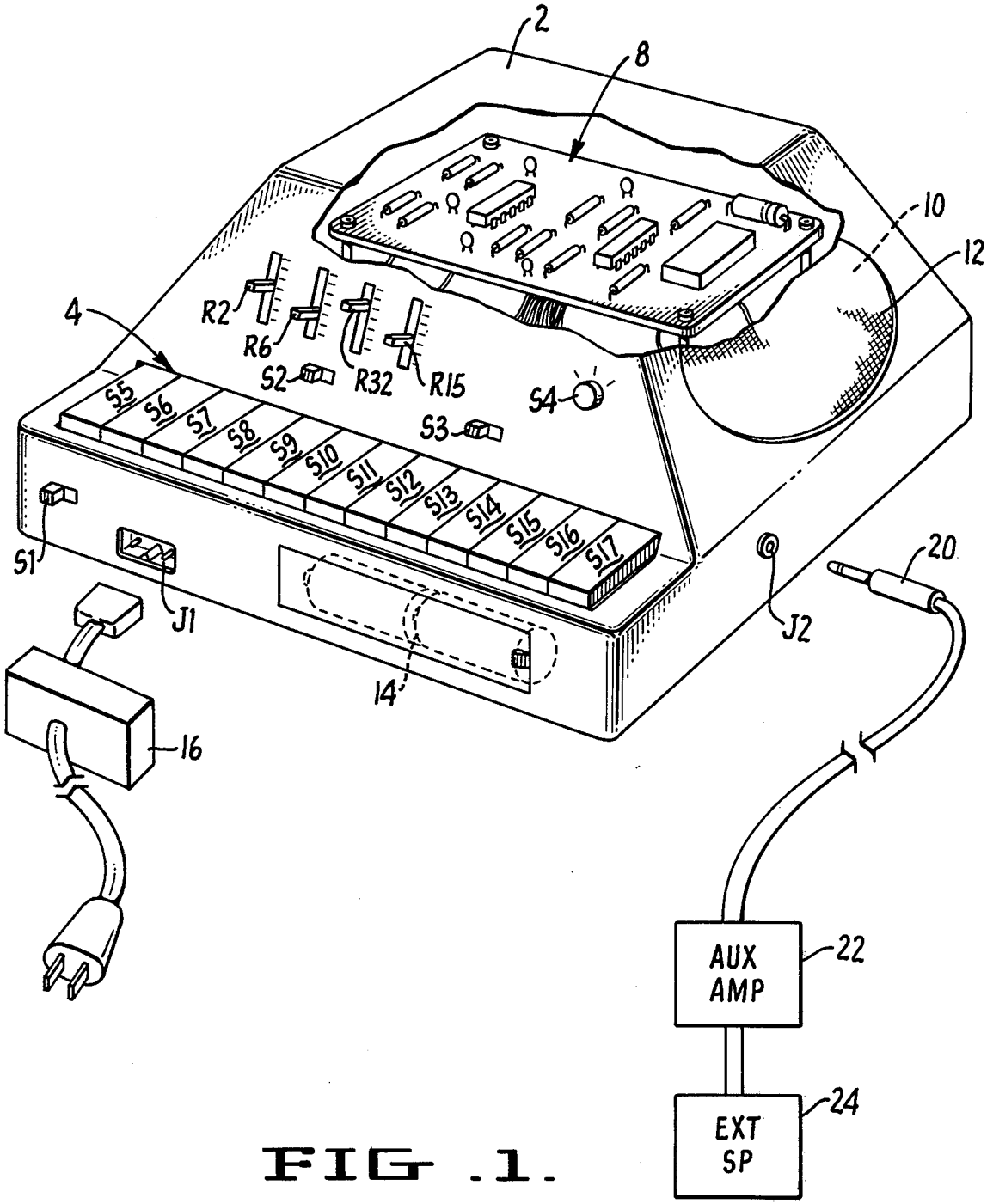
FIG. 1 is a perspective view, partially in section, of a preferred embodiment of this apparatus.

A preferred embodiment of the musical instrument of this invention is shown in FIG. 1, incorporated within a housing 2. Within this housing is incorporated the keyboard, generally indicated by reference numeral 4, octave control switch S4, a signal generating and processing circuitry generally indicated by reference numeral 8, and a loudspeaker 10, not shown but housed behind speaker grill 12. The instrument may be powered by self-contained batteries 14 or, through jack J1, by an external power supply 16 connected to line current. Similarly, the output of the instrument may be played not only through speaker 10 but also, if desired, through jack J2 and plug 20 to an auxiliary amplifier 22 and an external speaker 24.

Among the various switches provided on this instrument are a power switch S1 and waveform selector switches S2 and S3 for selecting the type of output waveform to be used to obtain the desired tonal effect, and octave selecting switch S4 for selecting the desired octave of the instrument's range. Several potentiometers R2, R6, R15 and R32, whose functions will be described below, are also provided in this embodiment for controlling other aspects of the operation. Keyboard 4 suitably comprises thirteen key switches, denominated S5 through S17, for selecting the individual notes within a chosen octave that are desired to be played.

Figure 2:
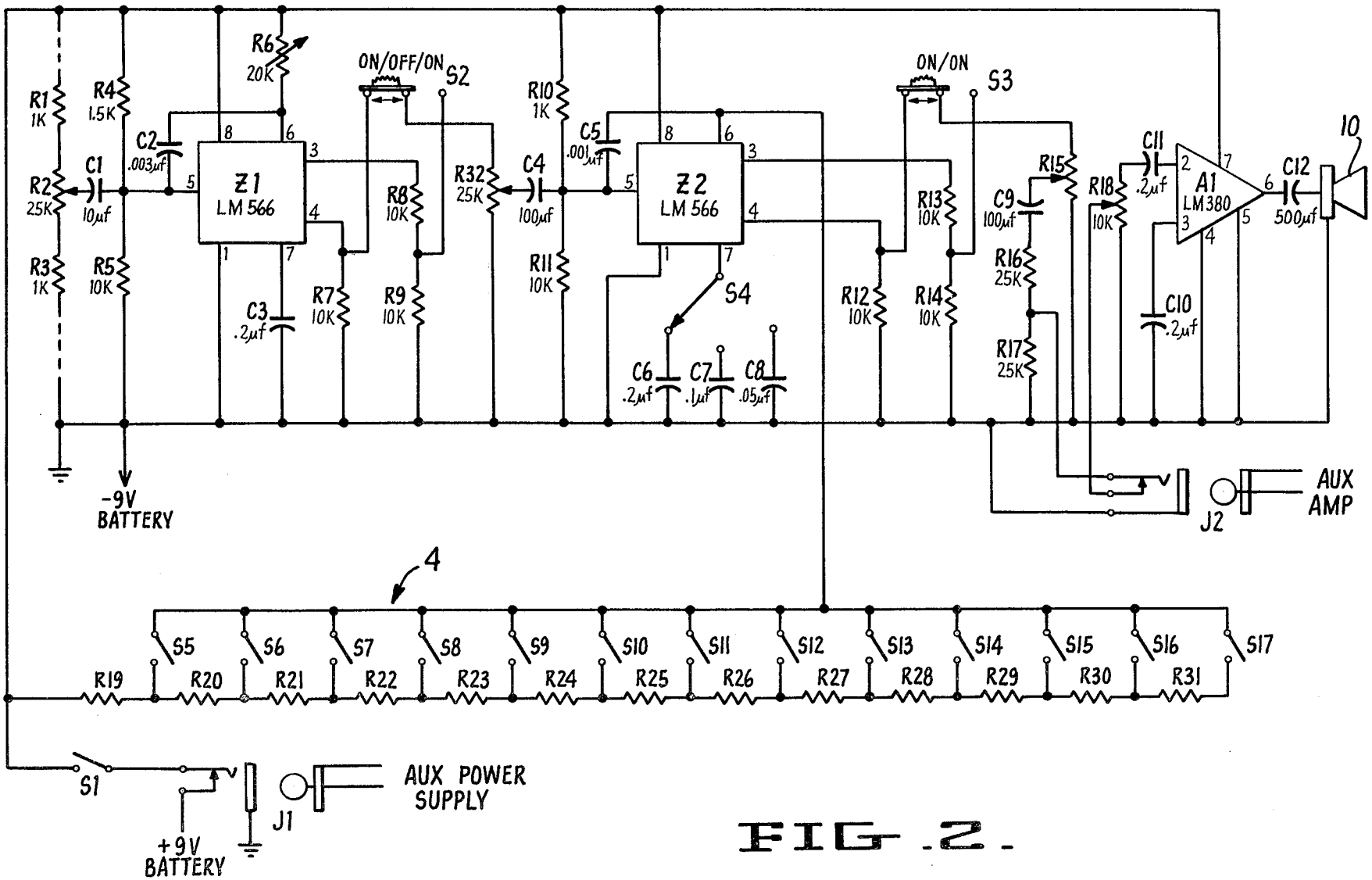
FIG. 2 is a schematic representation of the electronic circuitry of this preferred embodiment.

Within the housing 2 and operatively connected to the various power inputs, switches, potentiometers and outputs is a circuit which may suitably be such as is illustrated in FIG. 2. For ease of understanding and explanation, the components of the circuit of FIG. 2 which correspond to the various switches and potentiometers described above are given corresponding reference numbers.

The overall circuit of this preferred embodiment may be considered to have three general parts. The first part includes the components associated with a first voltage controlled oscillator Z1, which may suitably be an integrated circuit such as the commonly available LM-566. This portion of the circuit controls the tonal effects other than the pure frequency to be generated. Such tonal effects may include the rise and decay time of the signal and the nature of its sustained output as well as the general frequency range and the principal waveform of the output signal. The second portion of the circuit includes the components for the operator control of the tone frequency generator, including components relating to the octave switch S4 and the keyboard 4. The third functional portion of the circuit relates to the actual tone signal generator and includes the components associated with a second voltage control oscillator Z2, which also may suitably be an LM-566 integrated circuit. This third portion of the circuit also includes the components associated with the audio output, such as amplifier A1, which may suitably be an integrated circuit such as an LM-380 or LM-381, and, alternatively, the external auxiliary amplifier.

With respect to the first portion of the circuit, the resistors R4 and R5 form a voltage dividing network into pin 5 of Z1. Such an arrangement in this circuit, with R4 and R5 having the values of 1.5K ohm and 10 K ohm respectively provide a gross control on the overall frequency range of the instrument. This range is more tightly controlled by the combination of the potentiometer R6 and capacitor C3, whose values may suitably be chosen to provide a range of about 20 to 1 at the highest and lowest notes of the musical range of the instrument.

The R-C circuit comprising fixed resistors R1 and R3 and potentiometer R2, along with capacitor C1 and a voltage dividing network of R4 and R5, control the "attack" and "sustain" effects provided by Z1. Such attack and sustain effects may be provided by selectively controlling and varying the rise and decay time of the signal input to pin 5 of Z1. Capacitor C2 is provided between pins 5 and 6 as a bypass, for stability purposes.

Pins 3 and 4 of Z1 represent the outputs, one providing for a sawtooth waveform and the other for a square waveform. Since it is the output signals from these pins that will be used to control the operation of tone generator Z2, it is desirable to have the peak-to-peak voltage levels of both the square wave and sawtooth signals substantially the same. Since pin 3 normally will have about six volts peak-to-peak on its output while pin 4 has only about three volts peak-to-peak, the signal from pin 3 is fed to the effect selecting switch S2 through the voltage dividing network of R8 and R9 to provide a peak-to-peak signal of about three volts to both of the outside contacts of switch S2.

Switch S2 then provides for selection of the desired waveform, either sawtooth or square wave, from the effect-controlling circuitry relating to Z1. From switch S2 this AC component of the input control signal is then fed through potentiometer R32 and capacitor C4 to the input pin 5 of Z2. By the selective adjustment of potentiometer R32, the amount of the AC component of the input signal to pin 5, the tone "effect" control component from Z1, may be varied selectively by the operator to establish different "depths" of the desired effect. As before, the voltage dividing network of R10 and R11 provide for the DC signal input into pin 5. Bypass capacitor C5 is provided for similar purposes as capacitor C2 associated with Z1.

The actual frequency determination of the tone generator is controlled through the keyboard 4 input into pin 6 of Z2 and the octave selecting switch S4 input into pin 7. The keyboard, as noted above, comprises a plurality of key switches, suitably thirteen, such as indicated as switches S5 through S17. These keys provide for the selection of the desired resistance R19 through R31 to provide the desired input potential to pin 6 of Z2. These resistances suitably may be selected to have the following values:

R19—4,986 ohms
R20—297 ohms
R21—314 ohms
R22—332 ohms
R23—353 ohms
R24—373 ohms
R25—396 ohms
R26—419 ohms
R27—445 ohms
R28—470 ohms
R29—499 ohms
R30—528 ohms
R31—560 ohms Thus it may be seen that the values of the resistances R20 through R31 increase logarithmically. Such an arrangement provides for logarithmic changes in the musical notes selected, an arrangement which parallels the differences between the successive notes in a musical scale. In this manner the total chain of resistors, R19 through R31, adds up to a desired value for the lowest not in the octave of the scale selected, a note corresponding to the closing of switch S17 alone on keyboard 4. Selection of switches S15 down through S5 effect selection of successively higher notes in that octave.

Switch S4 selects one of a plurality of capacitors, such as capacitors C6, C7 and C8. It may be noted that these capacitors C6 through C8 are selected to have values which differ from one another in a linear fashion, C7 having a value half of C6 and C8 having a value half of C7. This arrangement, input to pin 7 of Z2, provides for variations among linearly spaced increments of the input into pin 7. This arrangement provides for imposing a linear change in the octave of the output of the tone generator, an arrangement which corresponds to the linear differences in frequency between successive whole octaves. Thus, the combination of control provided by the switches and resistors of keyboard 4 and the selection of capacitors C6, C7 or C8 by switch S4 uniquely provide for selection of the logarithmic change between successive notes and the linear change between different whole octaves, whereby all of the notes of a several octave range may be chosen and provided at the outputs of Z2.

As with Z1, selection of the signal output at pin 3 or pin 4 provides for the selection of either a sawtooth output waveform or a square wave output waveform from Z2. Switch S3 and resistors R12, R13 and R14 correspond in function with respect to the output of Z2 as switch S2 and resistors R7, R8 and R9 function with respect to Z1. By the provision of an input signal having either a sawtooth or a square wave AC component to pin 5 of Z2 and also the provision of an additional sawtooth or a square wave output of Z2 at pin 3 and pin 4, the tonal effects obtained by the differing waveform may be combined to give a wide range of audio effects, varying the richness and complexity of the output tone. From the center tap of switch S3 the output signal in this embodiment then passes through gain control potentiometer R15, capacitor C9 and a voltage dividing network of R16 and R17 either to the internally contained audio amplifier A1 or through jack J2 to the auxiliary amplifier 22 and external speaker 24. Jack J2 provides for opening the circuit to the internal audio amplifier A1 whenever the auxiliary amplifier is plugged in.

Connected to the audio amplifier A1, which suitably may be an LM-380 or LM-381 integrated circuit, is the volume control potentiometer R18 and capacitors C10 and C11 to the input. The output of amplifier A1 is fed through capacitor C12 to a suitable speaker 10.

By the use of circuitry such as described above, the instrument of this invention may be used to produce musical tone effects which are controlled in large part by the active electronic signal processing of the effect signal by the first voltage controlled oscillator Z1. Thus, the components associated with Z1, including the waveform selecting switch S2 and the potentiometers R2, R6 and R32 may be considered the tone effect control, providing an alternating current signal input to the tone signal generating voltage control oscillator Z2. With these various adjustable and selectable controls the tone effect output signal from Z1 may be varied to provide different waveform characteristics and selectively varying rise and decay times, as well as selectively varying amplitude and frequency. The keyboard, with switches S5 through S17 and resistors R19 through R31, may be considered in conjunction with the octave selecting control switch S4 and capacitors C6, C7 and C8 to be the tone frequency control. These tone effect control signals and tone frequency control signals input to the tone signal generator Z2 and its associated output amplifiers provide for generating an output tone signal whose frequency is proportional both to the resistance values selected from the keyboard 4 and the capacitance selected by the octave control S4 and which has a waveform corresponding at least partially to the tone effect control signal being provided from Z1. The waveform will correspond to the combination of the waveform of the tone effect control signal from Z1 and waveforms generated internally of Z2.

While the foregoing describes the basic circuitry and operation of this preferred embodiment, several other variations to provide more complex effects may also be included. For example, a small signal transistor such as a 2N2222 may be incorporated in the place of potentiometer R6 with a voltage controlled variable capacitor in the place of capacitor C3. These variations would allow for more flexible control of the audio effects in that feedback loops could be used from either the effect stage, associated with Z1, or from the tone generator stage, associated with Z2, or from an external generator such as another instrument. This arrangement could give additional desired attack and sustain effect and could also provide for vibrato, tremelo and other effects.

As is apparent, the apparatus of this invention thus provides for a far broader range of such special effects with far simpler equipment than has been available in prior art equipment, which commonly utilizes only passive filtering to remove undesired components for a signal generated by reeds or oscillators whose basic output signals are generated in a straightforward manner without active signal processing.

While the foregoing represents a particularly preferred embodiment of the electronic instrument of this invention, this description is to be considered illustrative only of the principles of the invention and is not limitative thereof. Since numerous variations and modifications of this apparatus, all within the scope of the invention, will readily occur to those skilled in the art, the scope of this invention is to be limited solely by the claims appended hereto.

What is claimed is:

1. An electronic instrument for producing musical tones comprising tone effect control means selectively controllable by an operator of the instrument to provide an alternating current output signal having selectably differing waveform characteristics and selectively varying rise and decay times and selectively varying amplitude and frequency;

manually operable tone frequency control means having both a selectively variable electrical resistance characteristic and a selectively variable capacitance characteristic, one of said characteristics being variable among logarithmically spaced increments and the other said characteristic being variable among linearly spaced increments; and tone signal generating means operatively connected both to the output of said tone effect control means and to said tone frequency control means for generating an output tone signal having a frequency proportional to both the selected resistance and the selected capacitance of said tone frequency control means and having a waveform corresponding at least partially to said tone effect control means output signal.

2. The instrument of claim 1 wherein said resistance characteristic is logarithmically variable and said capacitance characteristic is linearly variable.

3. The instrument of claim 1 wherein said logarithmically variable characteristic is variable among thirteen said logarithmically spaced increments.

4. The instrument of claim 1 wherein said control means includes a manually operable keyboard for controlling said logarithmically variable characteristic.

5. The instrument of claim 1 wherein said tone signal generating means comprises a voltage-controlled oscillator.

6. The instrument of claim 1 wherein said tone effect control means comprises a selectively controllable voltage-controlled oscillator.

* * * * *